United States Patent [19]

Janvrin

[11] 4,404,534

[45] Sep. 13, 1983

[54] ELECTROMAGNETIC ASSEMBLY

[75] Inventor: Robert B. Janvrin, Climax, Mich.

[73] Assignee: General Signal Corporation, Stamford, Conn.

[21] Appl. No.: 196,888

[22] Filed: Oct. 14, 1980

[51] Int. Cl.[3] ..... H01F 27/30

[52] U.S. Cl. ..... 336/197; 335/282; 336/198; 336/205

[58] Field of Search ..... 335/282; 242/118.4, 242/118.7; 310/42, 194; 336/197, 96, 198, 208, 205

[56] References Cited

U.S. PATENT DOCUMENTS

| | | | |
|---|---|---|---|
| 3,011,140 | 11/1961 | Mittenmaier et al. | 336/197 X |
| 3,264,593 | 8/1966 | Cole | 336/197 |
| 3,436,574 | 4/1969 | Larsson | 310/194 |
| 3,546,647 | 12/1970 | Roddy et al. | 242/118.4 X |
| 3,706,061 | 12/1972 | Loika, Jr. | 336/197 |
| 4,114,056 | 9/1978 | Nimura | 310/42 |
| 4,307,314 | 12/1981 | Yamada et al. | 310/194 X |

FOREIGN PATENT DOCUMENTS

| | | | |
|---|---|---|---|
| 316123 | 3/1934 | Italy | 242/118.4 |
| 252458 | 2/1964 | Netherlands | 310/194 |

*Primary Examiner*—Thomas J. Kozma

*Attorney, Agent, or Firm*—Thomas R. FitzGerald

[57] ABSTRACT

An electromagnetic assembly includes a core having an inner cylindrical portion and an outer cylindrical portion spaced from the inner cylindrical portion to provide space or a cavity for a bobbin. The bobbin is adapted to fit into the space provided in the core and has an elongated cylindrical body, a coil of wire wound around the body, and a flange at each end of the body for holding the coil on the body. A portion of one flange extends from the bobbin and overlaps a portion of the core. The bobbin is held in the core cavity by an interference fit provided between the overlapping, extended flange portion and the overlapped core portion.

9 Claims, 10 Drawing Figures

ELECTROMAGNETIC ASSEMBLY

BACKGROUND

This invention relates in general to electromagnetic assemblies, and in particular, to armature-type, magnetic holding assemblies.

In conjunction with mobile hydraulic equipment it is often desirable to provide such equipment with a feature for returning one or more of the elements operated by the equipment to a predetermined position. For example, on a frontend loader, it is desirable to have the bucket automatically returned to a level position and thereby be ready for the next load. Such automatic return features can be provided by biasing or detenting the movable valve element, such as the spool valve of a hydraulic control valve, to a predetermined position by suitable means. There are various means available to accomplish such detenting including mechanical means as well as electromechanical means.

A typical electromechanical means is a holding type electromagnet which acts on an armature plate that is mechanically coupled to one end of the spool by a stem. When the electromagnet is energized, the armature plate is held against the core of the electromagnet thereby completing the magnetic flux path and thus holding the spool member in the desired position against the normal opposing forces of the spool's centering springs. Such electromagnets typically are flat faced, armature-type magnetic holding coils assembled with one end of the core open and facing the armature plate. When the electrical energy to the coil is removed, the magnetic flux collapses and the spool's centering springs separate the armature plate from the core and return to the spool to its center or neutral position.

The electromagnetic assembly typically comprises a magnetic core having an outer cylindrical portion, an inner cylindrical portion, and a cavity between the two portions adapted to receive a bobbin that has been prewound with a coil of wire. The bobbin has to be retained by some means in the core cavity in order for the electromagnet to operate properly. However, there is little space available for any retaining means in order to achieve this purpose. This is so because the core area necessary to carry the magnetic flux is limited and therefore not available for any such retaining means.

Until now, one method used to retain the coil in place has been to glue the bobbin to the closed inner wall of the core cavity. Such a method is effective, but has several drawbacks. For one, it is time consuming inasmuch as the assembled unit will require drying time for the sealant to set. For another, care must be taken that the coil stays in its position until the sealant has dried and that all sealant is cleaned from the open face of the core and bobbin so as not to interfere with the armature plate. If the coil becomes damaged, then the entire assembly, including the relatively expensive core portion, has to be completely scrapped since the bobbin will remain permanently fixed to the core by the sealant.

Accordingly, it would be desirable to have another means for removably fixing the bobbin and coil in the core cavity.

In conjunction with other types of electromagnetic devices, there have been described a number of methods for holding a bobbin to a core. For example, U.S. Pat. No. 3,428,929 relates generally to a coil structure for tuned circuits in radio and television amplifiers. In that patent, there is described a method for locking a bobbin onto a core having a single cylindrical portion. The bobbin is locked onto the core portion by the windings of the coil which abut against the core through windows provided in the bobbin. An arcuate projection of the inner cylindrical portion of the bobbin is received in an elongated longitudinal depression in the surface of the core to enable the bobbin to be slid into its proper position.

In another U.S. Pat. No. 3,238,485, there is shown a bobbin, having a number of small, molded projections on its inner surface of a hollow tubular portion. The projections, resembling pin-type projections, can be forced into a corresponding shallow depression or groove in a cylindrical core in order to hold the core in place inside the bobbin.

In U.S. Pat. No. 4,048,606, there is described an inductive device which is said to reduce creepage by providing a bobbin with flanges having thinned-down edges for bending over a portion of the coil when the bobbin is inserted into a core. No mention is made of how the bobbin is secured to the core.

Still other examples of bobbin and core assemblies may be found in U.S. Pat. Nos. 4,114,056; 3,958,328; 3,843,946; and 3,314,032.

SUMMARY

My invention provides for a bobbin which is adapted to have an interference fit between itself and the core into which the bobbin is inserted. More particularly, my invention is an electromagnetic assembly that includes a core having an inner cylindrical portion and an outer cylindrical portion spaced from the inner cylindrical portion to provide space or a cavity for a bobbin. The bobbin fits into the space provided in the core and has an elongated cylindrical body, a coil of wire wound around the body, and a flange at each end of the body for holding the coil on the body. One flange has an interference tab that extends from the bobbin and overlaps a portion of the core. The bobbin is held in the core cavity, by an interference fit provided between the overlapping, extended tab and the overlapped core portion.

As such, it is contemplated that the invention can be used with ordinary, prewound bobbins as well as encapsulated bobbins. The interference fit can be provided on either one or both flanges, and, in the preferred embodiment, is provided on the inner flange, i.e. the flange adjacent the closed end of the core in the assembled electromagnet. It is also preferred that a plurality of interference tabs be used, three, four, or six, as required. In addition, the extended flange portion could be provided around the entire periphery of the flange.

On encapsulated coils, the die design could be adapted to provide flanges or tabs. However, it would be preferable to modify the die design to have a plurality of high spots at the flash line of the encapsulant. Since the encapsulant is generally a hard material, flexing due to assembly or temperature changes might damage the coil winding. Hence, the interference points could be included on the inner diameter of the bobbin which is usually made of a material softer than the outer diameter. Due to die design, these points would probably be best positioned near the open or last end of the bobbin to enter the core cavity.

The interference fit of my invention provides a primary, removable fixing means between the bobbin and the core. As such, the bobbin can be removed for service or replacement since it is not permanently glued to the core as is currently done. Moreover, the interference fit of my invention does not require expensive machining of the metallic core in order to provide a groove or other such receiving means for the interference tabs. Hence, the invention provides for a relatively inexpensive, and time saving means for assembling an electromagnet. It thus solves the problem of providing a retaining means for the coil in the limited space available for such electromagnets positioned in the ends of spool valves.

Having thus summarized the salient features of the invention, further reference may be had to the following detailed description of the invention and the accompanying drawing, wherein the invention as well as the best mode contemplated for carrying out the invention is shown and described in such full, clear, concise, and exact terms as to enable any person skilled in the art to make and use the invention.

DRAWINGS

FIG. 1*a* through 1*c* shows the invention having an inner flange with an integral interference tab portion;

FIG. 2*a* and 2*b* show a coil with a bobbin having a plurality of interference tabs;

FIGS. 3*a* and 3*b* show an encapsulated coil with interference points at the external flash line;

FIGS. 4*a* and 4*b* show an encapsulated coil having interference points along the inner diameter;

FIG. 5 is a combination schematic and sectional view of an electromagnetic assembly in conjunction with a hydraulic valve and system.

DETAILED DESCRIPTION

Figure 1A:
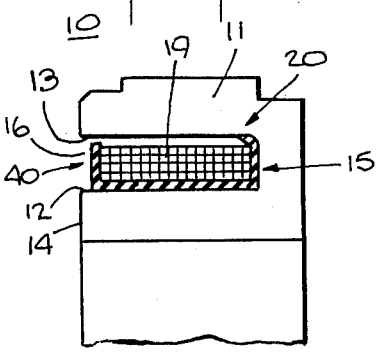

With reference to FIG. 1, there is shown an electromagnetic assembly 10 comprising a core 11 and a coil assembly 19. The core 11 is made of metallic, magnetic material and has an inner cylindrical portion 12 diametrically spaced from an outer cylindrical portion 13. The cavity 16 formed between the two spaced cylindrical portions 12, 13 provides space for the coil assembly 19. The coil assembly 19 is inserted into the open end 40 of core 11 and abuts against the closed end 15.

Figure 1B:
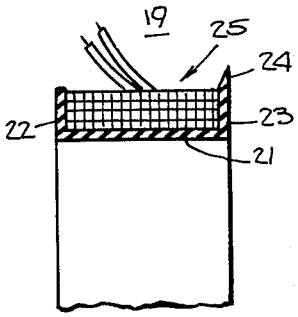
Figure 1C:
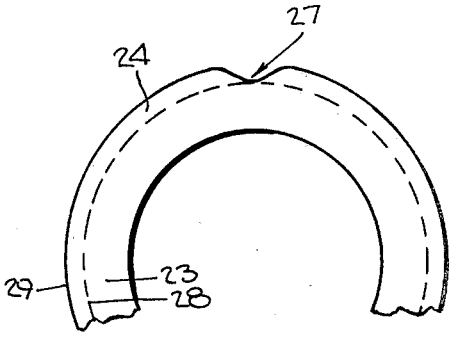

As shown in FIG. 1*b*, the bobbin 20 has a cylindrical body 21 with first and second flanges 22, 23 at opposite ends thereof. Flange 23 has in intregal extended interference portion 24. A coil winding 25 is wound around the cylindrical body 21 between the two flanges 22, 23. Electrical energy can be supplied to the coil winding 25 via coil lead wires 26. With reference to FIG. 1*c*, the interference portion 24 of flange 23 is shown as that portion extending from the dash line 28 to the outer solid line 29. Hence, as shown in FIG. 1*a*, the interference portion 24 of the inner or second flange 23 folds back slightly as the bobbin 20 is pressed into the cavity 16. A depression 27 can be provided to prevent damage to the lead wires 26.

Figure 2A:
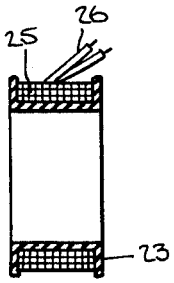

It has been found that the foregoing described embodiment of the invention may place excessive force on the bobbin when the bobbin is pressed into the cavity. Hence, there is a possibility that the coil winding 25 could be damaged. In order to minimize coil damage, the preferred embodiment of the invention uses a plurality of distinct, interference tabs, such as those shown in FIGS. 2*a, b*.

Figure 2B:
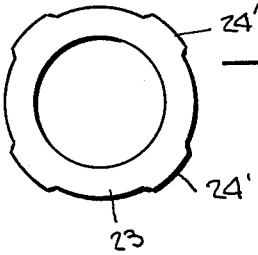

There, in FIG. 2*b*, is shown a bobbin having four elongated tabs 24' spaced from each other about the outer periphery of flange 23 and integral therewith. Since there is space between the tabs 24', the force needed to insert the bobbin 20 into the core 11 is substantially reduced, thereby minimizing the possibility of damage to the coil. The four tabs 24' shown in the preferred embodiment are not equally spaced from each other in order to give the coil 19 an irregular peripherial shape and thereby derive some spring action from the bobbin 20.

Figure 3A:
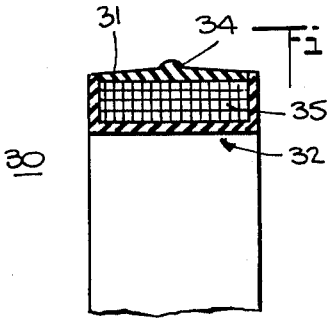
Figure 3B:
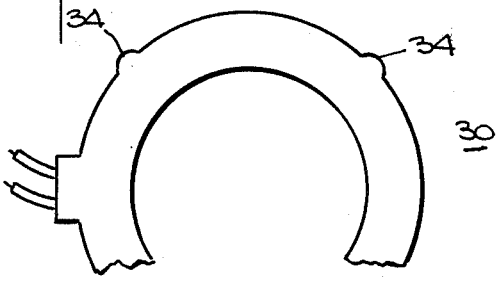
Figure 4A:
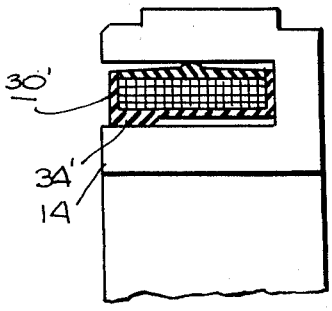
Figure 4B:
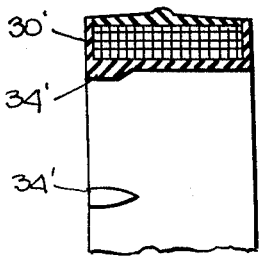

It is also contemplated that the invention can be used with encapsulated coils. Such an embodiment is illustrated in FIGS. 3*a, b* of the invention. There, an encapsulated coil 30 has its winding 35 encapsulated in an encapsulant 31. A plurality of high spots 34 are provided on the flash line of the encapsulant. These high spots 34 function in the same manner as the interference tabs 24'.

Since the encapsulant 31 is generally a hard material, flexing due to assembly or temperature changes may damage the coil winding 35. In order to prevent such damage, it is further contemplated that the bobbin 32 could have interference points 34' included on the inner diameter where a softer material is used. Due to die design, these points 34' would probably be near the outer end 14 of the assembly in order to facilitate the insertion of the coil 30' into the core 11.

Figure 5:
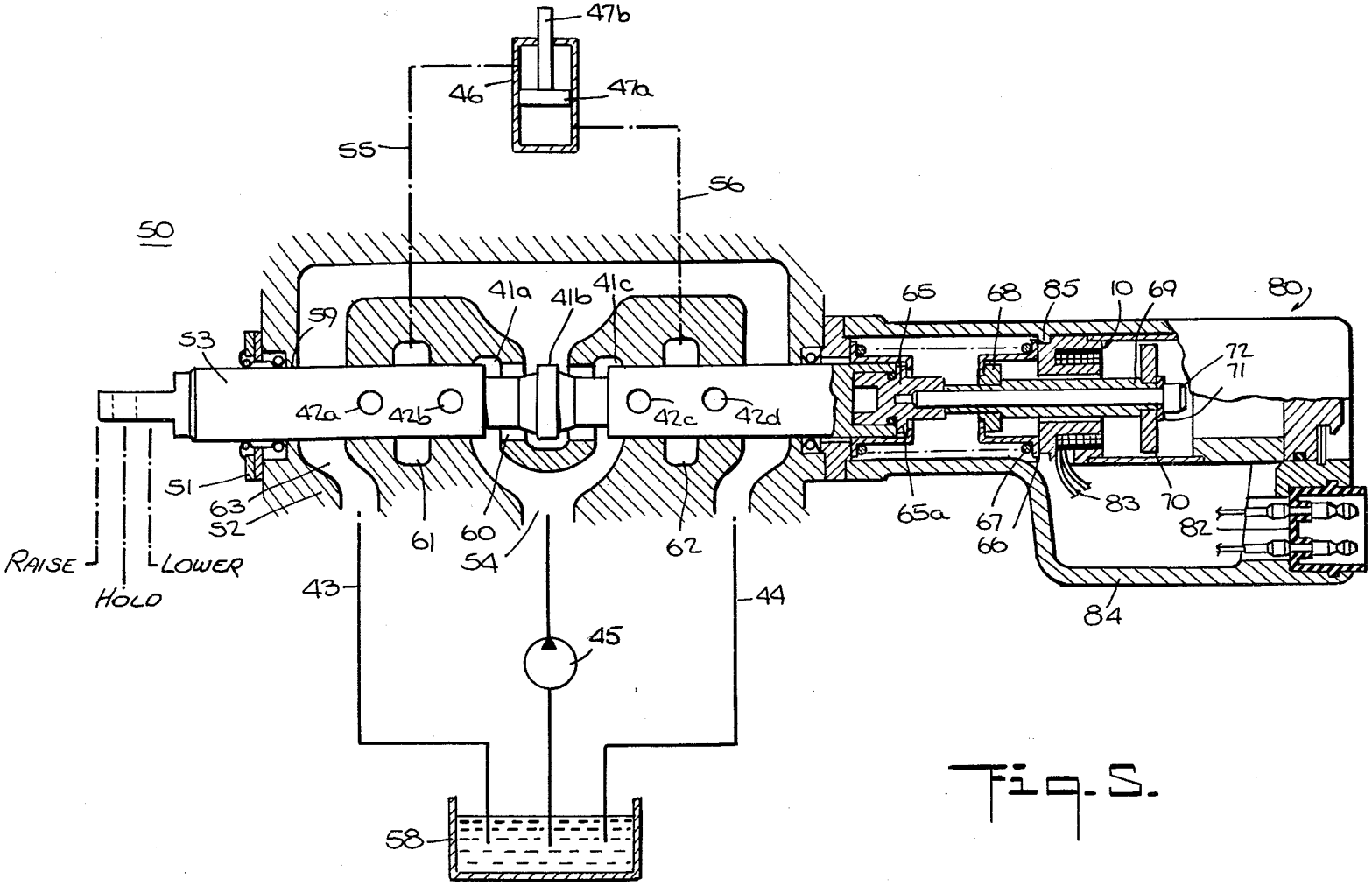

Turning now to FIG. 5, there is shown in general a hydraulic system 50 incorporating the magnetic assembly 10 of the subject invention. Hydraulic system 50 includes a directional control valve 51. Inside a housing 52 there is a bore 59 within which a spool valve element 53 may reciprocally move. A pump 45 draws fluid from a reservoir 58 and directs that fluid into the inlet port 54 of the valve 51. The fluid enters the inlet port 54 and fills a core chamber 60. In the neutral position, fluid leaves the core chamber 60 and passes into a tank chamber 63. From there, fluid is returned to a common tank or reservoir 58 via suitable return lines 43 and 44. Inside the housing 52 are a pair of service chambers, 61, 62. The service chambers 61, 62 are spaced on opposite sides of the center line of the valve, one each between the core chamber 60 and a portion of the tank chamber 63. Spool 53 has a blocked center portion and hollow portions on either side of the center. The hollow portions have a suitable number of drilled holes 42*a, b, c, d* and raised lands 41*a, c*. Land 41*b* is on the blocked center portion.

In a manner well known in the art, a load on the piston rod 47*b* of cylinder 46 can be raised, lowered or held in position. The latter is accomplished by shifting the spool 53 to either the right or to the left to thereby selectively interconnect the pump 45 with one of the service lines 55, 56 that lead from the service chambers 61, 62 to cylinder 46 on opposite sides of piston 47*a*. For example, when the spool is shifted to the left, core chamber 60 becomes sealed off on one side by spool lands 41*a*, and 41*b*. Accordingly, service line 55 is connected to the reservoir 58 via service chamber 61, drilled hole 42*b*, the interior core of the spool 53, drilled hole 42*a*, and tank chamber 63. The high pressure output fluid of the pump 45 is directed into the lower portion of cylinder 46 to thereby extend rod 47*b* and raise the load. That fluid connection is established by land 41*c* which seals off the core chamber 60 thus providing a fluid path through drilled hole 42*c*, the interior of spool 53, drilled hole 42*d*, service chamber 62, and service line 56.

As mentioned above, the magnetic assembly 10 of the invention is used to magnetically hold the spool 53 in a given position. In FIG. 5, the invention is arranged to hold the spool in its raise position. As such, the rod 47*b* will be extending. The rod 47*b* can be stopped and held in position if the electric current to the electrical detent 80 is shut off. A limit switch, proximity switch, or other suitable means can be used to turn off the detent 80 when the rod 47*b* travels its operational length. Then the spool will automatically return to the hold position by a suitable return spring.

The electromagnetic assembly 10 is a part of an electrical detent 80 which is attached to the righthand end of the valve housing 51. Electrical detent 80 has a housing 84 equipped with an electrical connector 82 for supplying the electrical energy from a source (not shown) via wires 83 to the magnetic assembly 10. The housing 80 has an interior reduced diameter portion 85 for holding the assembly 10 in position. When the spool 53 is shifted to its leftmost position, an armature plate 70 butts against the electromagnetic assembly 10. If the electromagnetic assembly 10 is energized, then it will hold the armature plate 70 in that position and thus overcome the forces of a recentering spring 67. The recentering spring 67 is held in place by a spring retainer 66. A back cap 65 is screwed into the righthand end of the spool 53. A shoulder 65*a* of the back cap 65 butts against one side of the spring retainer 66. A spacer ring 68 butts against the other side of the spring retainer 66. The spacer ring 68 also butts against a shoulder of a spacer sleeve 69 which carries the armature plate 70. The armature plate 70 is secured to the spacer sleeve 69 by means of a washer 71 and a screw 72 which threads into a threaded bore (not shown) of the back cap 65. Hence, the back cap 65, spacer ring 68, spacer sleeve 69, and armature plate 70 move as a common assembly against the retainer spring 67.

Having thus described the invention as well as its preferred embodiment in this mode of operation, those skilled in the art will recognize that other modifications and changes can be made to the particular embodiments described above without departing from the spirit and scope of the invention as set forth in the following claims.

I claim:

1. An electromagnetic apparatus comprising:

(a) an axially elongated metallic ferromagnetic core having (i) inner and outer axially extending walls radially spaced from each other to thereby define a cavity for enclosing a coil assembly, (ii) an annular opening in the core between the walls at one axial end thereof in order to permit the insertion or removal of a coil assembly.

(iii) an annular closure between the walls at the other axial end thereof defining the axial limit of the coil assembly cavity, (iv) an axial bore extending radial outward from the longitudinal axis of the core to the inner wall, open at both ends of the core and adapted to accommodate a reciprocating armature.

(b) a coil assembly adapted to fit in the core cavity and including (i) a cylindrical body, (ii) radial flanges on each end of the cylindrical body and sized to easily pass axially into the annular opening and between the walls of the core and into the core cavity, (iii) a coil of wire wound around the cylindrical body between the flanges thereof, and (iv) interference means carried by the coil assembly extending radially beyond the flanges and positioned abutting against at least one core wall in order to primarily support and removably hold the coil assembly in the core cavity between the walls thereof.

2. The invention of claim 1 wherein the interference means extends outwardly from the body.

3. The invention of claim 1 wherein the interference means extends inwardly from the body.

4. The invention of claim 1 wherein the body has a plurality of interference means.

5. The invention of claim 1 wherein the body has a plurality of interference means irregularly spaced apart from one another around a peripheral portion of the bobbin.

6. The invention of claim 1 wherein the coil assembly is encapsulated in an insulating encapsulant and the interference means is integral with the encapsulant.

7. The invention of claim 1 wherein the coil assembly is encapsulated, and the interference means extends from the encapsulant at the flash line thereof.

8. The invention of claim 1 wherein the interference means comprises an extended flange portion extending radially outwardly for overlapping the outer cylindrical core portion.

9. The invention of claim 1 wherein the interference means comprises an extended flange portion extending radially inwardly for overlapping the inner cylindrical core portion.

* * * * *